US005161694A

United States Patent [19]

Yoon et al.

[11] Patent Number: 5,161,694

[45] Date of Patent: Nov. 10, 1992

[54] METHOD FOR SEPARATING FINE PARTICLES BY SELECTIVE HYDROPHOBIC COAGULATION

[75] Inventors: Roe-Hoan Yoon; Gerald H. Luttrell, both of Blacksburg, Va.

[73] Assignee: Virginia Tech Intellectual Properties, Inc., Blackburg, Va.

[21] Appl. No.: 513,884

[22] Filed: Apr. 24, 1990

[51] Int. Cl.[5] ..... B03B 1/04

[52] U.S. Cl. ..... 209/5; 44/624; 44/627; 209/8; 209/9; 209/165; 209/167

[58] Field of Search ..... 44/608, 624, 627; 209/4, 5, 7, 8, 9, 165, 167

[56] References Cited

U.S. PATENT DOCUMENTS

| | | | |
|---|---|---|---|
| 3,371,988 | 3/1968 | Maynard et al. | 23/110 |
| 4,204,840 | 5/1980 | Yoo et al. | 44/624 |
| 4,272,250 | 6/1981 | Burk et al. | 209/5 |
| 4,331,447 | 5/1982 | Kamada et al. | 209/5 |
| 4,389,306 | 6/1983 | Nakanishi et al. | 44/627 |
| 4,484,928 | 11/1984 | Keller, Jr. | 209/5 |
| 4,533,086 | 8/1985 | Junttila | 209/5 |
| 4,537,599 | 8/1985 | Greenwald | 44/627 |
| 4,657,666 | 4/1987 | Snook et al. | 209/9 |
| 4,690,752 | 9/1987 | Shaw | 210/705 |
| 4,775,627 | 10/1988 | Attia et al. | 209/4 |

FOREIGN PATENT DOCUMENTS

| | | | |
|---|---|---|---|
| 800487 | 8/1958 | United Kingdom | 209/4 |

OTHER PUBLICATIONS

Nagata, S., 1975. Mixing: Principles and Applications, Halstead Press, New York. pp. 34–44.

Capes, C. E. et al, A Survey of Oil Agglomeration in Wet Fine Coal Processing. National Research Counsel, Ottawa, Canada (1984).

Appleton et al., 1975. Selective flocculation of cassiterite. Journal of the South African Institute of Mining and Metallurgy, 117–119.

Capes, C. E., 1989. Liquid phase agglomeration: Process opportunities for economic and environmental challenges. in: Challenges in Mineral Processing (K. V. S. Sastry and D. W. Fuerstenau, eds.), Society of Mining Engineers, Littleton, Colo., pp. 237–251.

Cheh, C. H., Glass, R. W. and Sehgal, R., 1982. Solvent recovery for the oil agglomeration coal cleaning process. SME-AIME Annual Meeting, Dallas, Tex., Feb. 14–18; Preprint No. 82–48.

Chia, Y. H. and Somasundaran, P., 1983. A theoretical approach to flocculation in carrier flotation for beneficiation of clay. Colloids and Surfaces, 8:187–202.

Christenson, H. K., Claesson, P. M., and Pashley, R. M., 1987. Proc. Indiana Acad. Sci. Chem. Sci., 98:379.

Claesson, P. M., Blom, C. E., Herder, P. C. and Ninham, B. W., 1986. J. Colloid Interface Sci., 114:235.

Delichatsios, M. A. and Probstein, R. F., 1975. J. Colloid Interface Sci., 51:394.

Derjaguin, B. V., 1934. Untersuchungen über die Reibung und Adhäsion, IV. Kolloid Z., 69:155.

Derjaguin, B. V. and Landau, L., 1941. Acta Phys. Chim. URSS, 14:633.

Derjaguin, B. V., Rabinovich, Ya. I. and Churaev, N. V., 1978. Nature (London), 272:313.

(List continued on next page.)

*Primary Examiner*—Peter Hruskoci

*Attorney, Agent, or Firm*—Mason, Fenwick & Lawrence

[57] ABSTRACT

A process of selectively agglomerating coal in an aqueous environment while leaving the mineral matter dispersed has been developed. This process is autogenous for hydrophobic particles in that neither an agglomerating agent nor an electrolytic coagulant is needed. It is based on the finding that hydrophobic particles are pushed against each other by the surrounding water structure. This process, which is referred to as selective hydrophobic coagulation, is driven by the so-called hydrophobic interaction energy, which is not included in the classical DLVO theory describing the stability of lyophobic suspensions. The relatively small coagula formed by the selective hydrophobic coagulation process can be readily separated from the dispersed mineral matter by several different techniques such as screening, elutriation, sedimentation and froth flotation.

37 Claims, 5 Drawing Sheets

OTHER PUBLICATIONS

Dryzmala, J., Markuszewski, R. and Wheelock, T. D., 1986. Influence of air on oil agglomeration of carbonaceous solids in aqueous suspension. Int. J. Miner. Process., 18:277-286.

Firth, B. A. and Hunter, R. J., 1976. Flow properties of coagulated colloidal suspensions. J. Colloid interface Sci., 57:248-256.

Frens, G. and Overbeek, J. T. G., 1972. Repeptization and the theory of electrocratic colloids. J. Colloid Interface Sci., 38:376-387.

Friend et al., 1973. Cleaning a selectively flocculated mineral slurry. Transactions Institute of Mining and Metallurgy, 82:C235-C236.

Friend et al., 1973. Some Physio-chemical aspects of the separation of finely-divided minerals by selective flocculation. Chemical Engineering Science, 28:1701-80.

Hamaker, H. C., 1937. Physica, 4:1058.

Israelachvili, J. N., 1978. Measurement of forces between surfaces immersed in electrolyte solutions. Faraday Discuss. Chem. Soc., 65:20.

Israelachvili, J. N. and Pashley, R., 1982. The hydrophobic interaction is long range, decaying exponentially with distance. Nature (London), 300:341.

Israelachvili, J. N. and Pashley, R. M., 1984. Measurement of the hydrophoibic interaction between two hydrophobic surfaces in aqueous electrolyte solutions. J. Colloid Interface Sci., 98:500.

Keller, D. V., Jr. and Burry, W. M., 1989. The demineralization of coal using selective agglomeration by the T-process. Coal Preparation, 6: in press.

Koh, P. T. L., Uhlherr, P. H. T. and Andrews, J. R. G., 1985. The effect of capillary condensation and liquid bridging on the bonding of hydrophobic particles in shear-flocculation. J. Colloid Interface Sci., 108(1):95-103.

La Mer, V. K. and Healy, T. W., 1963. The role of filtration in investigating flocculation and redispersion on colloidal dispersions. J. Phys. Chem., 7(11):2417-2420.

La Mer, V. K. and Healy, T. W., 1966. The nature of the flocculation reactions in solid-liquid separation. Solid-Liquid Separation (Pool, J. B. and Doyle, D., eds.) London, Her Majesty's Stationary Office, 44-59.

Pashley, R. H., 1981. Hydration forces between mica surfaces in aqueous electrolyte solutions. J. Colloid Interface Sci., 80:153.

Pugh, R. J. and Kitchener, J. A., 1971. Theory of selective coagulation in mixed colloidal suspensions. J. Colloid Interface Sci., 35(4):656-664.

Rabinovich, Ya. I., and Derjaguin, B. V., 1987. Direct measurement of forces of attraction of hydrophobized quartz fibers in aqueous KCl solutions. Kolloidn. Zh., 49:682.

Rabinovich, Ya. I., and Derjaguin, B. V., 1988. Interaction of hydrophobized filaments in aqueous electrolyte solutions. Colloids Surf., 30:243.

Read, 1971. Selective flocculation separations involving hematite. Transactions/Section C mineral processing and extractive metallurgy. 80:C24-C31.

Schulze, H. J., 1984. Physico-chemical elementary processes in flotation. Developments in Mineral Processing, 4, Elsevier, Amsterdam.

van Olphen, H., 1977. An Introduction to Clay Colloid Chemistry, 2nd edition, John Wiley and Sons, New York, Chapter 11.

Verwey, E. J. W. and Overbeek, J. Th. G., 1948. Theory of the Stability of Lyophobic Colloids, Elsevier, Amsterdam.

Warren, L. J., 1975. J. Colloid Interface Sci., 50:307-318.

Warren, L. J., 1981. Shear flocculation. Chemtech, Mar.:180-185.

Warren, L. J., 1984. Ultrafine particles in flotation. Principles of Mineral Flotation (Proceedings of the Wark Symposium), Austr. Inst. Mining, Brisbane, pp. 185-213.

Xu, Z. and Yoon, R. H., 1989. The role of hydrohobic interactions in coagulation. J. Colloid Interface Sci., 132(2):532-541.

Xu, Z. and Yoon, R. H., 1990. A study of hydrophobic coagulation. J. Colloid Interface Sci.; in press.

Yordan Hernandez, J., 1989. Studies on the stablity of thin films on bubble-particle adhesion. Ph.D. Thesis, Department of Mining and Minerals Engineering, Virginia Polytechnic Institute and State University, Blacksburg, Virginia.

METHOD FOR SEPARATING FINE PARTICLES BY SELECTIVE HYDROPHOBIC COAGULATION

BACKGROUND OF THE INVENTION

Numerous advanced coal cleaning processes have been developed in recent years. The main objectives of the various processes are two-fold: 1) to remove the impurities in the coal to the extent that it contains a very small amount of ash; and 2) to remove the sulfur to minimize the $SO_x$ emissions during combustion.

The resulting superclean (<2% ash) or ultraclean (0.8% ash) coals can be used to displace the oil and gas used in utilities and possibly for other applications. For coals containing mainly inorganic sulfur, a single advanced coal cleaning process may be able to meet both of the objectives. However, for those containing large amounts of organic sulfur, chemical or microbial coal cleaning processes may be necessary.

If the sulfur removal is still not in compliance with emission standards, scrubbers may have to be used in conjunction with the advanced coal cleaning processes. Since scrubbing is costly both in terms of capital and operation and maintenance (O&M) costs, there is an advantage to removing as much sulfur as possible prior to combustion. As a rule of thumb, the cost of conventional wet-scrubbing is estimated to be in the range of \$750.00 to \$1000.00/ton of $SO_2$ removed. If a utility burns a coal containing 2% sulfur, for example, it will have to spend \$27.00 to \$36.00/ton of coal, assuming that 90% of the sulfur is removed by scrubbing. If, on the other hand, the same coal is cleaned by an advanced coal cleaning process to 1.4% sulfur and the remaining sulfur is removed by a less costly, although less efficient, scrubbing technique, the utility can reduce the cost of scrubbing substantially. The duct injection process is regarded as one such technique that can remove approximately 70% of the sulfur at a cost of approximately \$500.00/ton of $SO_2$ removed. In this case, the utility can spend only \$9.80/ton of coal burned. A simplistic calculation as such may justify a combined use of advanced coal cleaning and scrubbing techniques. It also suggests that the cost of pre-combustion coal cleaning should not exceed \$17.00–26.00/ton of cleaned coal to be able to compete against the conventional wet-scrubbing techniques.

Of the various advanced coal cleaning processes being developed, the oil agglomeration process may be one of the most promising techniques. It is based on the fact that higher rank coals are more wettable in oily substances than the associated mineral matter. Thus, if an oil is added to an aqueous suspension of pulverized coal, the coal particles will be collected into the oil phase, while the mineral matter will remain in the aqueous phase, allowing the two to be separated from each other. When a sufficient amount of oil is added, the coal particles form agglomerates larger than 1 to 2 mm in diameter, which can be effectively separated from the dispersed mineral matter by screening.

The oil agglomeration process described above is simple and efficient, and the product coal shows improved dewatering characteristics. However, the process suffers from one problem, that is, high oil consumption. Typically, 10% or more of oil by weight of feed solids is required for cleaning coal containing large portions of −325-mesh material. At this rate, the cost of oil alone can easily make the process uneconomical as compared to the wet-scrubbing techniques. Therefore, a continuing battle has been waged in recent years to reduce the oil consumption. Stripping with superheated steam can recover the spent oil from the clean coal, but the reduction in O&M cost is estimated to be only 28% (Cheh et al, "Solvent Recovery for the Oil Agglomeration Coal Cleaning Process," SME-AIME Annual Meeting, Dallas, Tex., February 14–18, Pre-print No. 82–48 (1982)). This reduction is not enough to make the process competitive. More recently, Capes, "Liquid Phase Agglomeration: Process Opportunities for Economic and Environmental Challenges," *Challenges in Mineral Processing*, K.V.S. Sastry et al, Society of Mining Engineers, Littleton, Colo., pp. 237–251 (1989), reported that as little as 1% oil is sufficient if the agglomerates are separated by flotation. Nevertheless, the 1% oil is still an order of magnitude higher than what is normally required in conventional or advanced flotation processes.

Perhaps the most intriguing method of reducing the oil consumption is to use an agglomerant that can be readily recovered and recycled to the process. Otisca Industries, Inc., is now using pentane which has a boiling point of 36° C. and a low surface tension (17.3 dyne.cm). The amount of pentane used during the process of agglomeration is about 50% by volume of the recovered coal, but most of it is recovered for recycle by heating the product at 50° C. Using this process, Keller et al, "The Demineralization of Coal Using Selective Agglomeration by the T-Process," *Coal Preparation*, 6:(in press), (1989), showed that of the more than one hundred different coal samples tested, more than half yielded a product coal with ash contents less than 1%, and several were cleaned to less than 0.3% ash. The Btu recovery and pyritic sulfur rejection were both greater than 95%. Another example of using reusable agglomerant is the LICADO process, in which liquid carbon dioxide is contacted with an aqueous coal slurry at about 850 psi. There are other processes that are also designed to cut down the reagent cost by using reusable agglomerants. However, a common drawback of such effort is that the capital and the O&M costs are high. Furthermore, the potential hazards of using high-vapor pressure hydrocarbons and asphyxial gases such as carbon dioxide may hinder widespread use in commercial-scale operations.

The major advantage of the oil agglomeration process is that it is capable of recovering coal particles as small as a few microns in diameter or less. The ability to separate micron-sized particles is an important advantage when a coal must be pulverized to very fine sizes in order to liberate the mineral matter and pyritic sulfur more completely. It would, therefore, be advantageous to further improve the conventional oil agglomeration process to the extent that the oil consumption is no longer the impediment to upgrading coal, 0 graphite or any other naturally hydrophobic substances commercially.

For this reason, a novel agglomeration process has been developed, in which in accordance with the present invention no oily agglomerant is required for separating fine particles of hydrophobic material from the associated hydrophilic ones. The process is autogenous in that it requires virtually no reagent. It is based on an improved understanding of the most fundamental mechanisms by which the stability of aqueous suspensions are controlled. For the reasons described hereinafter, the process in accordance with the present invention has been named "selective hydrophobic coagulation."

SUMMARY OF THE INVENTION

It is the primary object of this invention to provide a method of separating hydrophobic material such as coal or the like from non-hydrophobic material such as the mineral matter associated with coal in an aqueous medium by exploiting the hydrophobic interaction energy in a manner that is both inexpensive and free of environmental problems.

It is another object of the invention to provide an economical method of producing low-ash and low-sulfur coals using the selective hydrophobic coagulation process which does not require an agglomerant.

It is another object of the invention to provide a method of separating hydrophobic coal or the like from its associated non-hydrophobic mineral matter in such a way that the recovery rate does not decrease as the size of the coal or of the like is reduced.

It is another object of the invention to provide a method of separating hydrophobic coal from its associated non-hydrophobic mineral matter in a manner that the rejection of coal pyrite is improved as compared to the conventional oil agglomeration or the froth flotation processes.

It is another object of the invention to provide a method of separating coal or the like from its associated mineral matter without consuming large amounts of oil.

It is still another object of the invention to provide a method of separating coal or the like from its associated mineral matter without using large amounts of dispersants.

These and other objects of the invention are achieved by provisions of a method for separating fine particles suspended in an aqueous medium. In this technique, one or more of an originally dispersed hydrophobic component is selectively coagulated to achieve separation from dispersed hydrophilic component(s). These components, which are in the form of fine particles, are originally dispersed due to the repulsive electrostatic surface forces which prevent the particles from approaching one another. In the present invention, an attractive surface force, which is referred to as "hydrophobic interaction force" and which, as is evident in the classical DLVO theory, has not been considered heretofore in describing the stability of lyophobic colloidal suspensions, is utilized. The hydrophobic interaction force is inherent to any hydrophobic substance such as coal, graphite, elemental sulfur, molybdenite, diamond, talc, poly(tetrafluoroethylene) "TEFLON" etc., and its magnitude varies with the degree of hydrophobicity of the material of concern. In the classical DLVO theory, the van der Waals attraction force, which is also referred to as dispersion force, is considered as the only force for attracting like particles to each other and forming coagula. The present invention shows, however, that for very hydrophobic particles such as unoxidized bituminous coal and graphite, the dispersion force is negligibly small compared to the hydrophobic interaction force at a distance where particles begin to feel the presence of other approaching particles. For this reason, the hydrophobic interaction force is considered to be the major driving force for coagulating hydrophobic materials such as bituminous coal and graphite or any other moderately-to-strongly hydrophobic substances.

An important embodiment of the present invention is the control of the relative magnitudes of the repulsive electrostatic surface force and the attractive hydrophobic interaction force. The electrostatic force can be manipulated by simple pH control or by the addition of appropriate electrolytes if necessary. The bituminous coals and graphite as mined usually possess sufficient hydrophobic interaction force to induce coagulation; however, for those coals that are not sufficiently hydrophobic due to oxidation or for any other reason can be treated with a very small amount of hydrocarbon oil, in an amount well below what is normally required for the conventional oil agglomeration process, to enhance the hydrophobicity. Another important embodiment of the present invention is that to achieve desired selectivity, the pH of the suspension can be adjusted so that the mineral matter to be separated from is fully dispersed while the coal or graphite can be coagulated by the hydrophobic interaction force.

With strongly hydrophobic coals and graphites, there is no need for using oily agglomerants, suggesting that the present invention is essentially an autogenous process. Also, there is no need for providing high-shear agitation to induce the coagulation because the attractive hydrophobic interaction force associated with unoxidized coals and graphites are usually high enough to counterbalance the repulsive electrostatic force. In this case, the agitation may be needed in as much as there is a need for increasing the rate of particle-particle collision. When the repulsive force is considerably larger than the attractive force, on the other hand, there may be a need for providing a sufficient kinetic energy for the particles to overcome the energy barrier. When the difference is relatively small, the thermal motion of the particles or a low intensity agitation is sufficient to provide a sufficient kinetic energy for the particles to overcome the energy barrier. If the difference is very substantial, however, the electrostatic force can be reduced by controlling the pH of the suspension or by adding electrolytes in the amount which is exceedingly small as compared to what is typically used for electrolytic coagulation of hydrophilic particles. Usually, the small amount of various ions present in tap water is sufficient to reduce the repulsive electrostatic force, so that no high-shear agitation is required. This is different from the oil agglomeration process, in which high-shear agitation is essential for dispersing the large amount of oil added to the suspension. An obvious advantage of the present invention is that significant savings in the costs of oily agglomerants and of high-shear agitation can be realized. Another advantage of the present invention is that since no oily agglomerant is used, the potential for removing coal pyrite is substantially increased. The reason is that the coal pyrite tends to abstract some of the oily substances and become hydrophobic, which will make it difficult for separating the pyrite from coal during the process of oil agglomeration.

After the fine particles of the hydrophobic component such as coal or graphite have been coagulated selectively, the coagula which are now much larger than the dispersed particles of the hydrophilic component(s) such as mineral matter are separated by means of simple screening, elutriation, decantation, centrifugal sedimentation, or any other suitable method. Since the coagula are hydrophobic and the dispersed phase is hydrophilic, they can also be separated by means of froth flotation. This is an advantage over the selective flocculation process, in which the froth flotation technique cannot be employed because the flocs are hydrophilic.

As a means of enhancing the process of separating the coagula from the dispersed material, large particles of hydrophobic material are coagulated with small hydrophobic particles, so that the resulting coagula become significantly larger than those formed using large particles. The large hydrophobic particles can then be recovered for reuse. Similarly, hydrophobized magnetic particles can be used to enhance the separation process.

A better understanding of the disclosed embodiments of the invention will be achieved when the accompanying detailed description is considered in conjunction with the appended drawings, in which like reference numerals are used for the same parts as illustrated in the different figures.

FIGS. *7a*, *7b* and *7c* are diagrammatic representations of the first, second and third steps, respectively, in accordance with one embodiment of the method in accordance with the present invention, and apparatus thereof.

Figure 8:
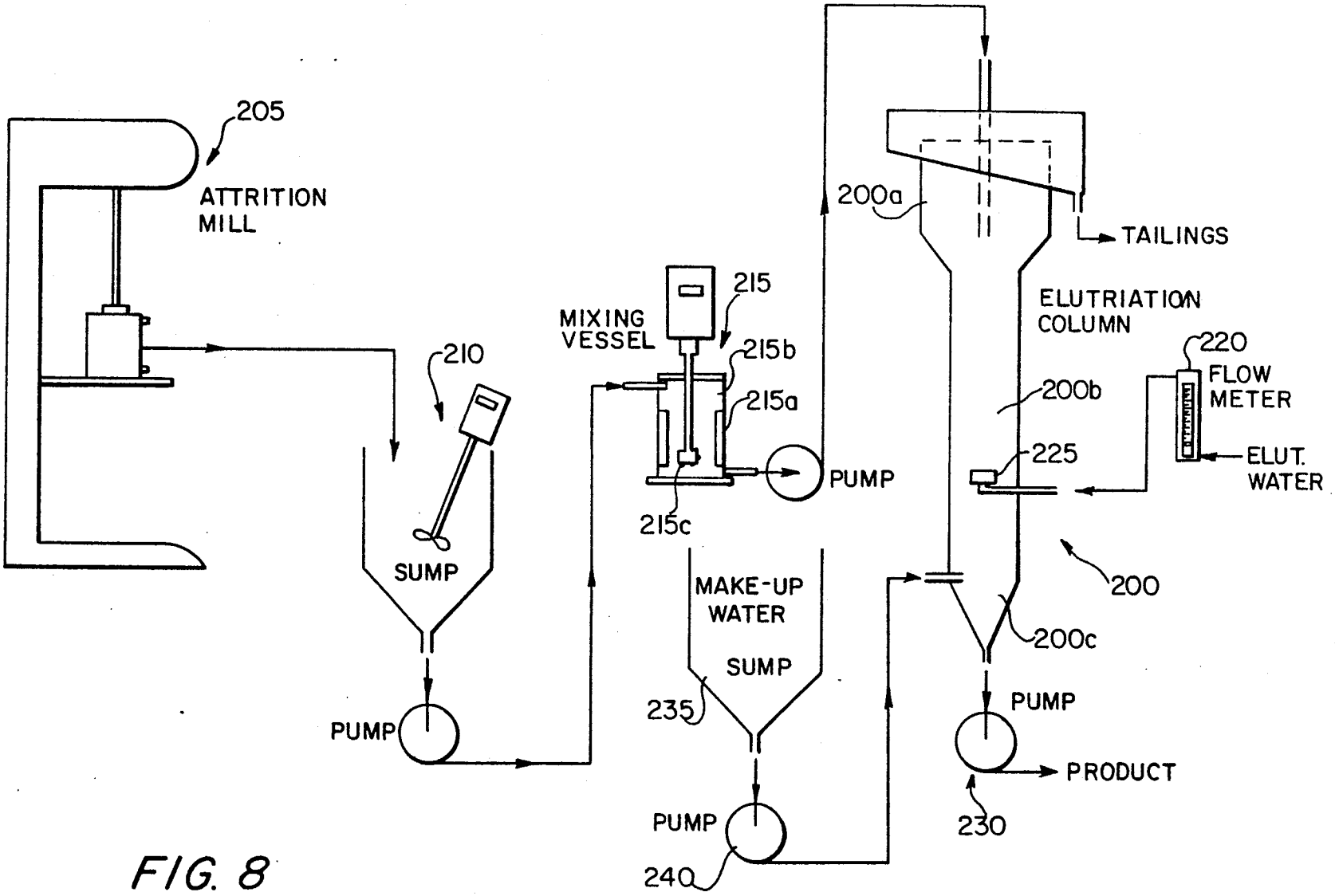

FIG. 8 is a diagrammatic representation of another embodiment of the method in accordance with the present invention carried out using an elutriation column.

Figure 9:
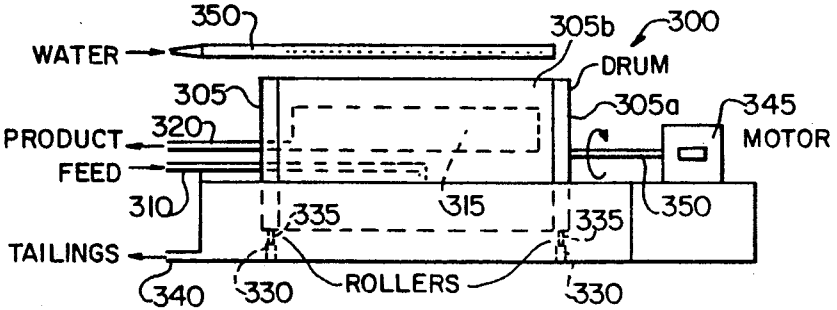

FIG. 9 is a side diagrammatic representation of a drum separator for carrying out a third embodiment of the method in accordance with the present invention.

Figure 10:
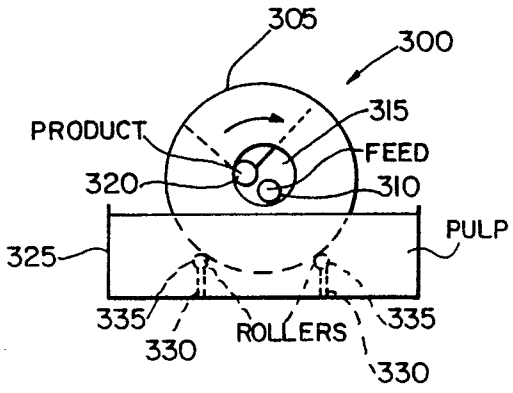

FIG. 10 is a front diagrammatic representation of the drum separator of FIG. 9.

DETAILED DESCRIPTION OF THE PREFERRED EMBODIMENTS

A. Description Of Working Principles

Through a series of experiments, we have established the fundamental mechanisms of the selective hydrophobic coagulation process in accordance with the present invention and determined the various parameters that affect the process of separating hydrophobic material such as coal and graphite from the associated hydrophilic material such as ash-forming minerals and $SO_x$-forming pyrite.

Control of the stability of colloidal dispersions is practiced in a variety of different industries, and has interested chemists and engineers for many years. Biologists, for example, are concerned with aggregation of blood platelets (agglutination) in blood clotting. In the paper industry, engineers must keep the pigments in aqueous suspension. The coal-water mixture (CWM) technology in the coal industry hinges on keeping the particles in suspension. In the mineral industry, engineers are concerned with improving the rate of thickening and filtration by controlling the state of aggregation.

A colloidal dispersion is said to become unstable when particles agglomerate and settle to the bottom of the container. The agglomeration can be induced by adding electrolytes ("electrolytic coagulation") or synthetic or natural flocculants ("flocculation"). La Mer et al, "The Role of Filtration in Investigating Flocculation and Redispersion of Colloidal Dispersions," *J. Phys. Chem.*, 67(11):2417–2420, (1963); and "The Nature of the Flocculation Reactions in Solid-Liquid Separation," *Solid-Liquid Separation*, J. B. Pool et al, eds., London, Her Majesty's Stationary Office, 44–59 (1966)), strongly advocated that the distinction between coagulation and flocculation be made on the basis of the different mechanisms involved.

"Coagulation" refers to the process of aggregation in which particles are brought together by the mechanism described by the DLVO theory. According to this theory, which will be discussed later in further detail, electrolytes added to the suspension reduce the electrostatic repulsive force between two like particles, so that they can approach each other closely enough for the London-Van der Waals' force to cause aggregation. Since this process is induced by the addition of electrolytes, the process is referred to as "electrolytic coagulation." The amount of electrolytes needed to induce the coagulation, i.e., the critical coagulation concentration (CCC), decreases as the inverse 6th power of the valence of the counter ions of the electrolyte, as embodied in the well-known Schulze-Hardy rule. Thus, divalent ions such as $Ca^{2+}$ and trivalent ions such as $Al^{3+}$ are used effectively to coagulate negatively-charged particles.

U.S. Pat. No. 3,371,988 (Maynard et al) developed a process of selectively coagulating anatase ($TiO_2$) impurities from kaolin clay in which a peptizing agent such as sodium hexametaphosphate and sodium silicate was added in excess of what is needed to obtain the minimum viscosity. If the amount of reagent used was at least twice the optimum needed, they found that the anatase coagulated while the clay remained in suspension. At such a high reagent dosage, the excess electrolyte may have reduced the zeta-potential of anatase to below that of clay by a phenomenon generally known as double layer compression. According to Pugh et al, "Experimental Confirmation of Selective Coagulation in Mixed Colloidal Suspensions," *J. Colloid Interface Sci.*, 35(4):656–664, (1971), a 20 mV to 30 mV difference in the zeta-potentials is ideal for the selective electrolytic coagulation of one mineral from the other.

"Flocculation" refers to the process in which particles are brought together by soluble macromolecules such as starches, aliginates, gums and a variety of synthetic polymers, by a bridging mechanism. Flocculation is characteristically much more rapid than coagulation. Flocs formed as such are generally much larger than coagula and have a loose, open structure.

Warren, "Shear Floccoulation," *J. Colloid Interface Sci.*, 50:307–318 (1975); *Chemtech*, March:180–185 (1981); and "Flocculation of Stirred Suspensions of Cassiterite and Tourmaline," *Colloids and Surfaces*, 5:301–319, (1982)), coined the term "shear flocculation," in which particles hydrophobized by proper surfactant coating can be aggregated by subjecting the suspension to high-shear agitation. He noted that "shear coagulation occurs only when the energy of impact of colliding particles is sufficient to overcome an as-yet undefined energy barrier preventing their spontaneous coalescence."

This theory is based on the conjecture that high-shear agitation can indeed provide enough kinetic energy to overcome the energy barrier, which can be predicted by the widely accepted DLVO theory.

The DLVO theory, which was named using the initials of the early developers, namely, Derjaguin et al, *Acta Phys. Chim.*, URSS, 14:633 (1941); and Verwey et al, "Theory of the Stability of Lyophobic Colloids", Elsevier, Amsterdam (1948), suggests that coagulation of particles is controlled by two competing energies, i.e., repulsive electrostatic interaction energy ($V_R$) and attractive London-van der Waals dispersion energy ($V_A$). Thus, the total interaction energy ($V_T$) between two particles of the same kind is given by:

$$V_T = V_R + V_A. \quad [1]$$

For spherical particles of radius, a, separated by a distance, H, the electrostatic repulsive energy becomes (Derjaguin, *Kolloid Z.*, 69:155 (1934)):

$$V_R = \frac{\epsilon a \psi_d^2}{2} \ln[1 + \exp(-kH)] \quad [2]$$

in which $\epsilon$ is the dielectric constant, k the Debye reciprocal length, and $\psi_d$ is the Stern potential. It has been shown that $\psi_d$ can often be substituted by the zeta-potential ($\zeta$).

The dispersion interaction energy can be calculated using the equation (Hamaker, *Physica*, 4:1058 (1937)):

$$V_A = -\frac{aA_{131}}{12H} \quad [3]$$

in which $A_{131}$ is the Hamaker constant for two spheres of 1 in a medium, 3.

Figure 1:
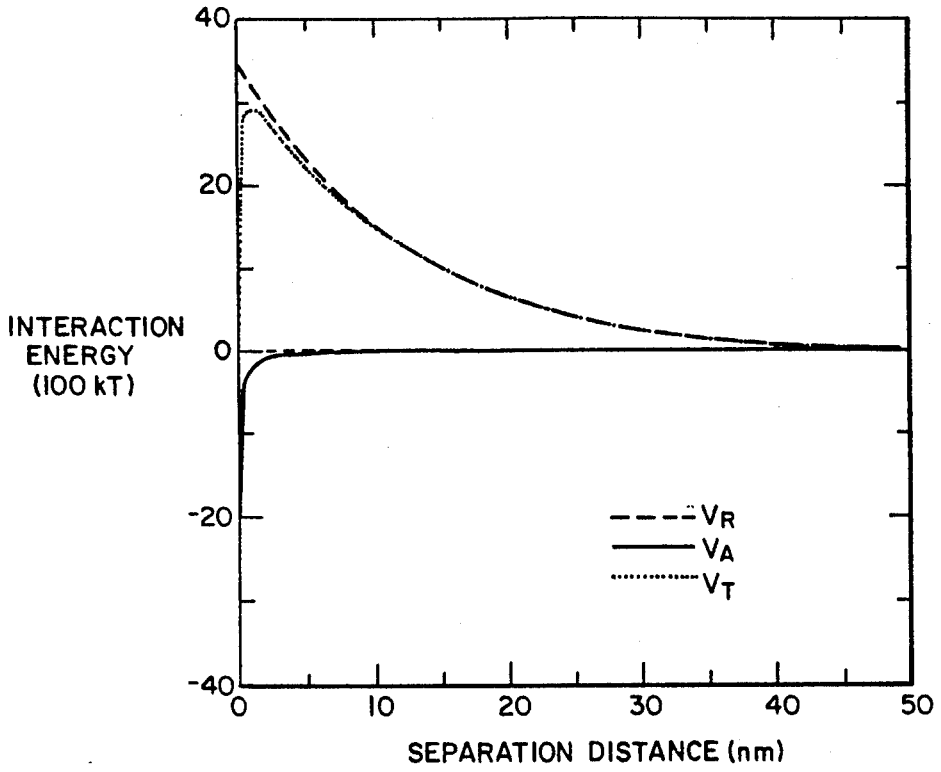
FIG. 1 is a potential energy profile calculated using the classical DLVO theory as a function of separation distance for fresh coal samples under the given set of conditions.

Using Equation [1], one can readily determine $V_T$ as a function of H, provided that the values of $\zeta$ and $A_{131}$ are available for a given system. FIG. 1 shows the result of a sample calculation made for 5-micron coal particles suspended in $10^{-3}$ moles/l KCl solution at pH 8.9, for which $\zeta = -43.0$ mV and $A_{131} = 5.24 \times 10^{-21}$ erg. It shows that $V_T$ reaches a maximum ($V_{max}$) of 2,924 kT at about 1.2 nm. According to the shear coagulation theory put forth by Warren, the coal particles will coagulate if a high-shear agitation can provide a kinetic energy in excess of 2924 kT. Xu et al, "The Role of Hydrophobic Interactions in Coagulation," *J. Colloid Interface Sci.*, 132(2):532–541 (1989), showed, however, that a maximum of 60 kT of kinetic energy provided by means of moderate mixing was sufficient to bring about the aggregation. In this regard, the term "shear flocculation" may be a misnomer for the case of hydrophobic coals.

In fact, the kinetic energy provided by mixing is not nearly enough to overcome the typical energy barriers predicted by the classical DLVO theory. Warren, *J. Colloid Interface Sci.*, 50:307–318 (1977); and "Ultrafine Particles in Flotation," *Principles of Mineral Flotation*, Proceedings of the Wark Symposium, Austr. Inst. Mining, Brisbane, pp. 185–213 (1984), incorrectly estimated the kinetic energy provided by mixing for 1-micron particles to be about 1000 kT. This calculation was made assuming a value of 5 cm/sec for the velocity of particles in stirred tanks. However, the kinetic energy calculated for a 1-micron scheelite particle (SG = 6.0) at 1700 rpm using the method described by Delichatsios et al, *J. Colloid Interface Sci.*, 51:394 (1975); Nagata, "Mixing: Principles and Applications," Halstead Press, New York (1975); and Xu et al, "A Study of Hydrophobic Coagulation," *J. Colloid Interface Sci.*, 134(2):427–434 (1990), is only 0.45 kT. Warren's calculation was based on the absolute velocity, which is not a realistic assumption in calculating the kinetic energies of colliding particles in a fluid. Chia et al, "A Theoretical Approach to Flocculation in Carrier Flotation for Benefication of Clay," *Colloids and Surfaces*, 8:187–202 (1983), used a value of 0.22 cm/sec as the relative velocity of the 1.1-micron anatase particles, and obtained only 6.5 kT as the kinetic energy for collision. It appears, therefore, that the major role of the high-shear agitation employed in Warren's experiments may simply be to increase the rate of aggregation, at least for very small particles, rather than to provide sufficient kinetic energy to overcome the energy barrier.

Figure 2:
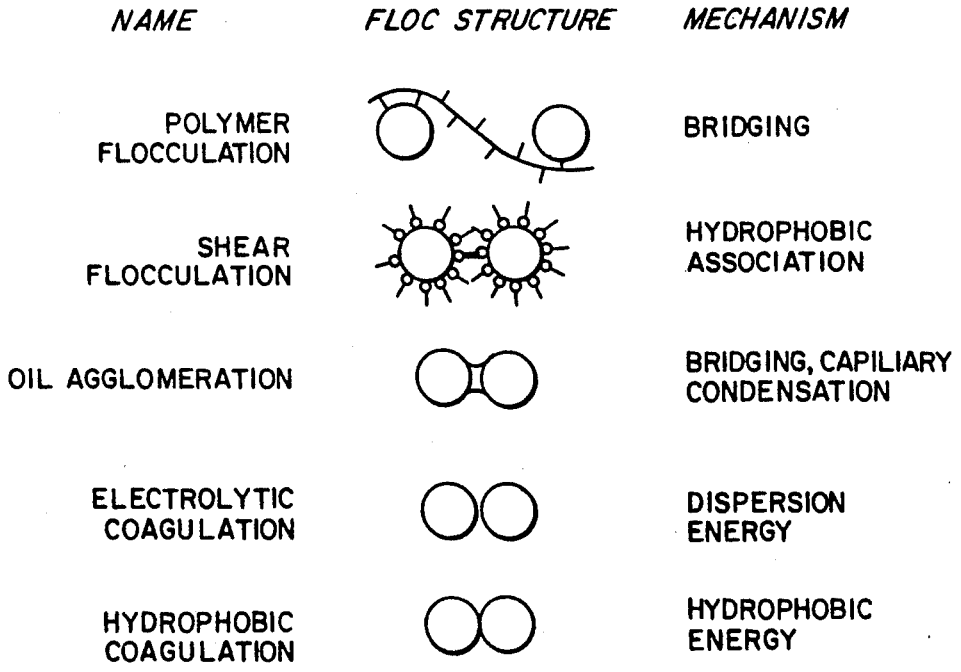
FIG. 2 is a schematic illustration of the aggregation mechanisms for various fine particle processes.

Nevertheless, the process described by Warren may be aptly referred to as "flocculation," in that the hydrocarbon tails of the adsorbed oleate molecules are actually "touching, overlapping or intermingling with each other," using the words of Warren (1975, 1981). This is similar in form to the process of polymer flocculation (FIG. 2). The close association of the hydrocarbon tails will give rise to a significant negative free energy change, as is the case with micellization. Knowing that the free energy of micellization is in the range of −0.9 to −1.2 kT/mole of $CH_2$ group, Warren (1975) estimated the attractive energy due to the association of hydrocarbon tails to be on the order of 1000 kT to 10,000 kT for a 1-micron particle. The fact that such a large amount of energy can be gained from the association of hydrocarbon tails provided an explanation to Warren for the flocs to be able to withstand the high-shear agitation that was employed in his experiments.

Apparently, only those surfactants that have sufficiently long hydrocarbon chains can cause the shear flocculation. While sodium oleate and sodium laureate coatings on cassiterite ($SnO_2$) produced aggregation, styrene phosphonic acids could not, despite the fact that the latter could make the mineral surface hydrophobic enough to stick to the surface of air bubbles (Warren, 1982). It was explained by Warren that "the short hydrocarbon chain may be too short to give a significant energy of hydrophobic association when the chains on colliding particles overlap." Koh et al, "The Effect of Capillary Condensation and Liquid Bridging on the Bonding of Hydrophobic Particles in Shear-Flocculation," *J. Colloid Interface Sci.*, 108(1):95–103 (1985), proposed that during the process of shear flocculation, particles are also held together by a type of "liquid bridge" formed at the point of contact. This bridge is formed by the capillary condensation of undissociated oleic acid. This mechanism further substantiates the idea that surfactant-coated particles are held together by a bridging mechanism in a similar manner as in polymer flocculation.

The bridging mechanism also operates in "oil agglomeration" (FIG. 2). When using a small amount of oil, e.g., less than 5% by weight of the coal for particles less than 0.5 mm, and intense agitation, particles form unconsolidated flocs by forming pendular bridges in a two-dimensional network. When such flocs are recovered on a screen, the yield is poor because of the poor integrity of the agglomerates. The flocs also tend to trap unwanted hydrophilic mineral matter and water which do not drain away readily. For this reason, the volume of settled agglomerates increases with increasing oil addition in this pendular flocculation region (Drzymala et al, "Influence of Air on Oil Agglomeration of Carbonaceous Solids in Aqueous Suspension," *Int J. Miner. Process.*, 18:277–286 (1986). With a larger amount of oil, e.g., 5% to 15% by weight of the coal, some of the pendular bridges coalesce to form a three-dimensional network. In this funicular region, the number of oil junctions per particle increases with increasing amounts of added oil, which results in a decrease in the amount of mineral matter and water entrapped. With a further increase in oil addition, all the voids are filled with oil and spherical agglomerates or pellets are formed. In this capillary wetting region, the entrapment of mineral matter and water becomes minimal and, therefore, the process becomes most efficient in terms of ash rejection and dewatering characteristics. For typical fine coals of less than 0.5 mm, this capillary wetting region is reached in the 15% to 20% range (Capes, 1989), while for micronized coals it is obtained in the 45% to 55% range (U.S. Pat. No. 4,484,928 (Keller)). This is perhaps the main reason that the Otisca-T process is so successful for producing ultraclean coals. Since most of the oil (pentane) used in this process is recovered, it can be affordable to use such a large amount. This certainly will not be the case, however, when "disposable" oil is used as the agglomerant.

Even for those processes that employ "reusable" oils, the cost of recycling such large quantities of oil should amount to a significant part of the overall cost. Therefore, an agglomeration process in which the amount of oil can be reduced substantially would be highly desirable. The "selective hydrophobic coagulation process" in accordance with the present invention is a new method of agglomerating coal without using oil. It has been developed by us on the recognition that the classical DLVO theory is inadequate for describing the stability of very hydrophobic particles suspended in aqueous solutions. It has been missing a third term dealing with the hydrophobic interaction energy. Based on the coagulation experiments conducted on coal and methylated silica, Xu et al, (1989, 1990), developed an expression for the hydrophobic interaction energy term, so that:

$$V_T = V_R + V_A + V_H \quad [4]$$

in which $$V_H = -\frac{aC_m}{1 + \exp[b(W_a^{nd} - K)]} \exp\left(\frac{H}{D_o}\right). \quad [5]$$

The negative sign indicates that $V_H$ is an attractive energy, which varies with the separation distance (H) exponentially with a decay length, $D_o$. It is also a function of particle size (a) and the non-dispersion component of work of adhesion ($W_a^{nd}$) of water on the solid in question. Equation [5] has three parameters, which have been determined to be as follows: $C_m = 1.95 \times 10-17$; b=0.49; and K=34.8, when a is in microns, H is in nm and $V_H$ is in J. These parameters have been determined from the coagulation experiments conducted with a Lower Cedar Grove coal from Virginia that was oxidized to different extents as a means of changing $W_a^{nd}$. The values of the three parameters determined using methylated silica, using different concentrations of trimethylchlorosilane (TMCS) solutions, appeared to be the same, but further work is necessary to see if those values can be applied universally.

Figure 3:
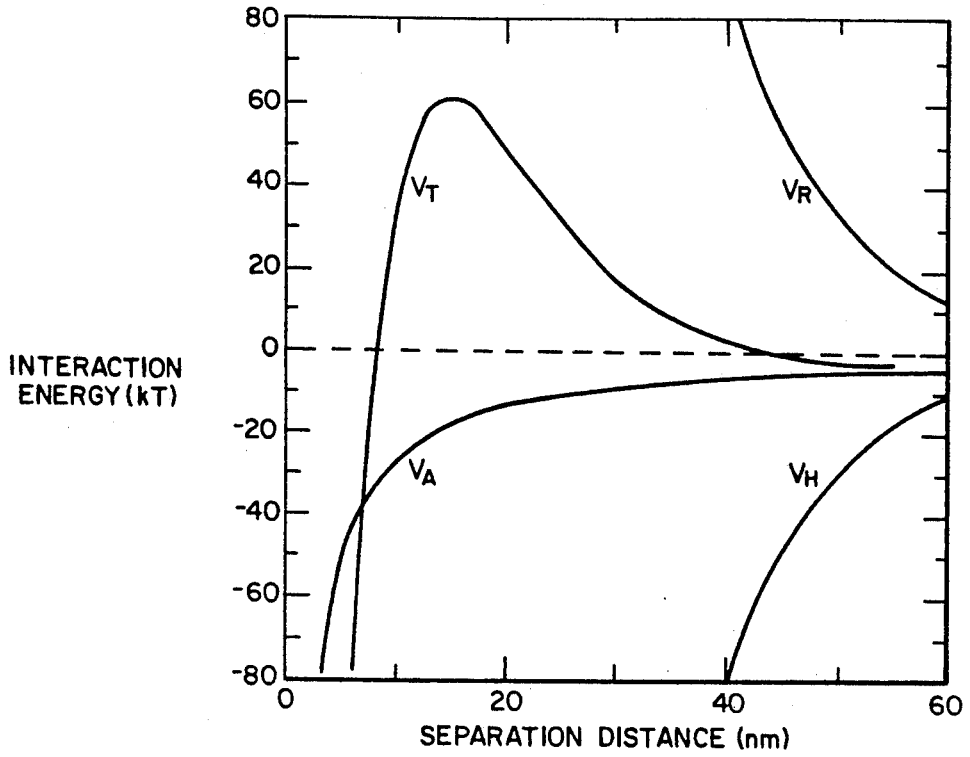
FIG. 3 is a potential energy profile as a function of separation distance for fresh coal samples under the given set of conditions.

FIG. 3 shows the $V_T$ versus H plot made using Equation [4] for the coal sample, for which DLVO calculation has already been made (FIG. 1). Thus, FIGS. 1 and 3, respectively, compare the results of the DLVO calculations made with and without including the hydrophobic interaction energy term given by Equation [5]. Two major differences may be delineated:

i) Of the two attractive energies, i.e., the dispersion energy ($V_A$) and the hydrophobic interaction energy ($V_H$), the latter is of greater importance when two particles begin to interact with each other at a greater separation distance; and ii) The maximum energy barrier ($V_{max}$) is reduced by almost two orders of magnitude when the hydrophobic interaction energy ($V_H$) is included.

The existence of $V_H$ has been proven experimentally by many investigators (Israelachvili et al, *Nature*, (London), 300:341, (1982); *J. Colloid Interface Sci.*, 98:500, (1984); Claesson et al, *J. Colloid Interface Sci.*, 114:235, (1986); J. Christenson, *Dispersion Sci. Technol.*, 9:171, 1988; and Rabinovich et al, *Kolloidn. Zh.*, 49:682, (1987), using direct force measurement devices. However, there is still a controversy as to the origin of this non-DLVO energy. Many investigators, Israelachvili, *Faraday Discuss. Chem. Soc.*, 65:20, (1978); Israelachvili et al, (1982, 1984); Claesson et al, (1986); Rabinovich et al, *Colloids Surf.*, 30:243, 1988; and Derjaguin et al, (1978)), consider it to be entropic in origin, arising mainly from the configurational rearrangement of water molecules in the vicinity of hydrophobic surfaces, while others believe that it is due to phase changes in the interlayer between two surfaces in close proximity (Claesson, *J. Colloid Interface Sci.*, 114:235, (1987); J. Pashley, *Colloid Interface Sci.*, 80:153, (1981); and Christenson et al, *Proc. Indian Acad. Sci. Chem. Sci.*, 98:379, (1987)), or to anomalous polarization of water molecules near hydrophobic surfaces.

At this point, we subscribe to the entropic theory. It is conceivable that the water film in the vicinity of a hydrophobic surface is thermodynamically unstable. According to Schultze, "Developments in Mineral Processing," *Elsevier*, Amsterdam, (1984), the thickness of this unstable hydration sheath is on the order of 170 nm for very hydrophobic solids. In our laboratory, the thickness of the unstable water film has been measured to be in the range of 70 nm to 145 nm for methylated silica depending on the degree of hydrophobicity (Yordan, "Studies on the Stability of Thin Films on Bubble-Particle Adhesion," *Ph.D. Thesis*, Department of Mining and Minerals Engineering, Virginia Polytechnic Institute and State University, Blacksburg, Va., (1989)). When two hydrophobic particles approach each other, these unstable films must rupture before coagulation can occur. During this process, the water molecules in the hydration sheath must be released into the bulk water phase, which will result in an increase in entropy because the water molecules in the vicinity of hydrophobic solids have lower degrees of freedom. The entropy increase may, thus, be the driving force for the "hydrophobic coagulation."

When two or more hydrophobic particles are brought together by virtue of the hydrophobic interaction energy ($V_H$) and form aggregates, it should be referred to as "hydrophobic coagulation." The term "coagulation" is appropriate here because the mechanism can be described by the modified DLVO theory (Equation [4]). Since there are no bridging mechanisms involved, it should not be called "flocculation." For the case of electrolytic coagulation, particles are considered to be separated by about 0.75 nm (Warren (1981); Frens et al, *J. Colloid Interface Sci.*, 38:376-387, (1972); and Firth et al, *J. Colloid Interface Sci.*, 57:248-256, (1976)), while the separation distance may be appreciably shorter for hydrophobic coagulation. This is borne out by considering that the hydrophobic interaction energy is generally larger than the dispersion interaction energy, although it all depends on the degree of hydrophobicity of the particles involved.

Since there are no bridging mechanisms involved, the process of hydrophobic coagulation requires no reagent. The only reagent that may be needed would be one that will help prevent the associated mineral matter from electrolytically coagulating. This can often be achieved by simple pH control. If a coal is oxidized, on the other hand, a small dose of reagents to enhance the hydrophobicity may be useful. For most unoxidized U.S. coals, however, no such reagents are necessary. Furthermore, there is no need to employ a high-shear agitation since the energy barrier is relatively low (FIG. 3), contrary to what is predicted from the classical DLVO theory (FIG. 1). This is also a distinguishing feature from the shear flocculation process advocated by Warren. He used 30 to 60 minutes of high-shear agitation to flocculate the oleate-coated scheelite particles. Another potential advantage of the selective hydrophobic coagulation process may be that since no hydrocarbon oils are used, separation of pyritic sulfur would be easier than with those processes using large amounts of oil.

However, the size of the coagula produced by hydrophobic coagulation tends to be smaller than that of the flocs produced by the conventional oil agglomeration process. Fine screens may be used for separating the coagula from the dispersed mineral matter. Several other techniques may also be used, as will be described hereinafter.

B. Description Of The Process And Experiments

We have conducted a number of experiments to establish the best possible methods of producing coagula of hydrophobic particles such as finely pulverized coal and graphite and of separating them from the dispersed hydrophilic particles such as the mineral matter associated with the coal and the graphite, and to establish the effects of various physical parameters on the selective hydrophobic coagulation. The list of parameters studied includes pH, particle size, percent solids, agitation time, rotational speed of the impeller, and slurry medium type (i.e., distilled water or tap water). Also, since all agglomeration processes have a problem with entrapment of gangue material in the agglomerates, the number of treatment stages required to sufficiently reject the mineral matter was studied.

For use in the tests, coals from the Pittsburgh No. 8, Elkhorn No. 3, Illinois No. 6, and Upper Freeport seams were chosen. Low-grade crystalline and amorphous graphite samples were also used. The Pittsburgh No. 8 is a major coal seam in the U.S., and contains large amounts of pyritic sulfur that can be removed by a physical coal cleaning process such as the selective hydrophobic coagulation process. The Elkhorn No. 3 coal is well-known for its low sulfur content and for having petrographic characteristics that allow deep cleaning. It is a major low-sulfur coal in the U.S. and is the prime candidate for producing superclean (<2% ash) or ultraclean (<0.8% ash) coals.

1. Batch Tests

The initial selective coagulation experiments were conducted using a 6" diameter mixer 100, shown in FIGS. *7a* and *7b*, which has four ½" Plexiglass baffles 110 placed vertically along the inside walls at equal distances apart. A 3" serrated Cowles disk impeller 120 was rotated at 1800 rpm. It was found later that selective hydrophobic coagulation in accordance with the present invention could be achieved at much lower rpm, depending on the chemistry of the system. In general, significantly lower impeller speed was sufficient for the coagulation when using tap water, as compared to the case of using distilled water. This can be explained by the lowering of the repulsive electrostatic force and, hence, the potential energy barrier ($V_{max}$) by the small amount of ions present in the tap water. For the case of processing the Elkhorn seam coal, good results were obtained at an impeller speed as low as 250 rpm in tap water. When processing graphite, however, no agitation was necessary to induce the hydrophobic coagulation even in distilled water. Thus, the requirement for the minimum impeller speed depends on the height of the potential energy barrier, which in turn is determined by the relative magnitudes of the repulsive electrostatic force and the attractive hydrophobic interaction force.

Typically, 20 grams of a coal sample with about 5-micron median size was placed in the mixer 100, diluted with tap or distilled water to 2% solids by weight, and the pH was adjusted to a desired value using either sodium hydroxide or hydrochloric acid solutions to form a suspension or slurry 130. Each test was carried out in three steps, shown respectively in FIGS. *7a*, *7b* and *7c*. Initially, as shown in FIG. *7a*, the coal suspension 130 was agitated for 5 minutes to disperse the mineral matter, promote particle-particle collision and produce aggregates. The slurry 130 was then allowed to stand for 5 minutes, as shown in FIG. *7b*, during which time aggregates 140 grew in size and settled to the bottom while the mineral matter remained in suspension 150. The dispersed phase containing the mineral matter was then siphoned off from the mixer, as shown in FIG. *7c*, leaving the settled coal 140 at the bottom. In most cases, it was necessary to repulp the settled material and repeat the process several times to remove the minerals entrained in the settled phase and those entrapped inside each coagulum. The products from the final stage of cleaning were filtered, dried and assayed.

Figure 4:
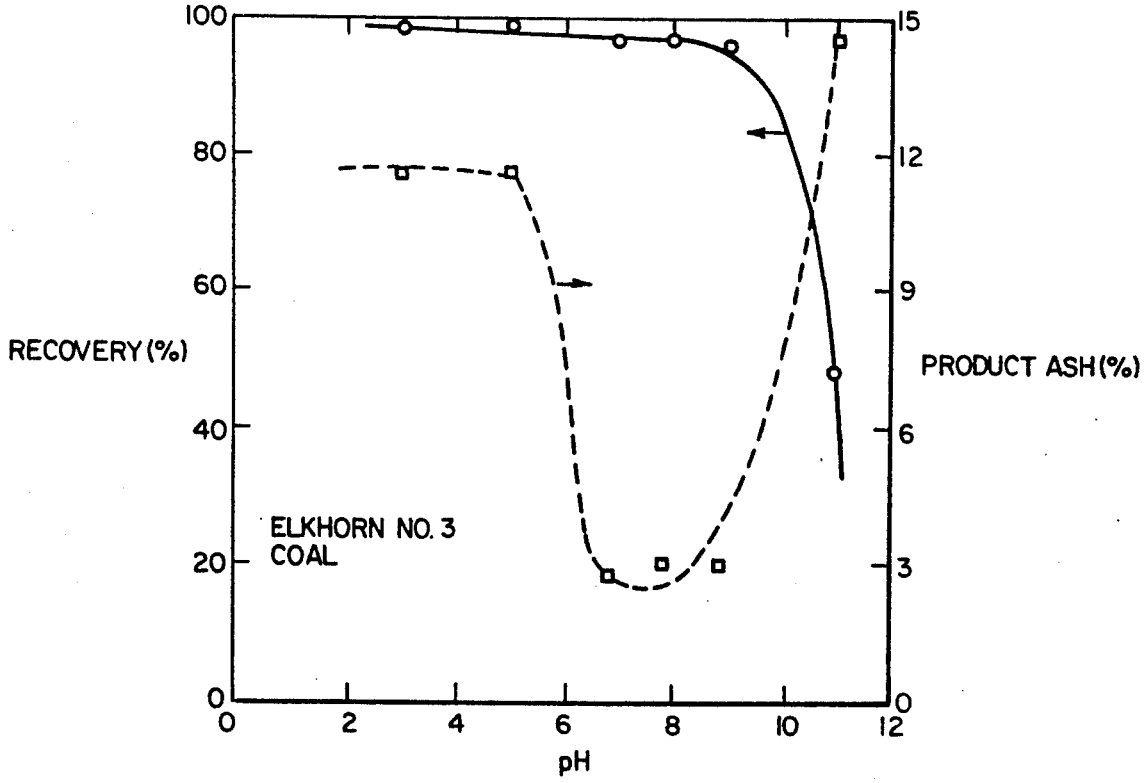
FIG. 4 is a graph showing the effect of pH on coal recovery and product ash content in the process in accordance with the present invention after three cleaning stages in tap water for an Elkhorn No. 3 seam coal.

FIG. 4 shows the results obtained with an Elkhorn No. 3 coal (feed ash 12%) after three stages of cleaning in tap water. At pH values between 3 and 5, a very high combustible recovery was obtained, but the products were high in ash. The high recovery may be attributed to the fact that the isoelectric point of the coal was found to be in this region, where the electrostatic repulsion was minimized due to reduced zeta-potentials. There may be several reasons for the high ash content in the products obtained in this pH region. These include self-coagulation of clay (Van Orphen, *An Introduction to Clay Colloid Chemistry,* Chapter 11, (2nd Ed., John Wiley and Sons, New York 1977)), heterocoagulation between minerals and coal (slime coating), and homocoagulation of the ash-forming minerals.

At very high pH values, both coal and mineral matter were well dispersed, resulting in a low coal recovery and a high ash content. In fact, the settled material had higher ash contents than the feed, because heavier minerals settled faster than the coal. At pH values between 7 and 9, however, there was a window of selectivity. The coal recovery was in excess of 95% and the product ash was as low as 3% or less. In this rather narrow pH range, only the hydrophobic coal particles coagulated selectively due to the hydrophobic interaction energy, while the hydrophilic minerals remained sufficiently dispersed. In this particular example, the only reagent used for the selective coagulation process was a pH modifier.

Figure 5:
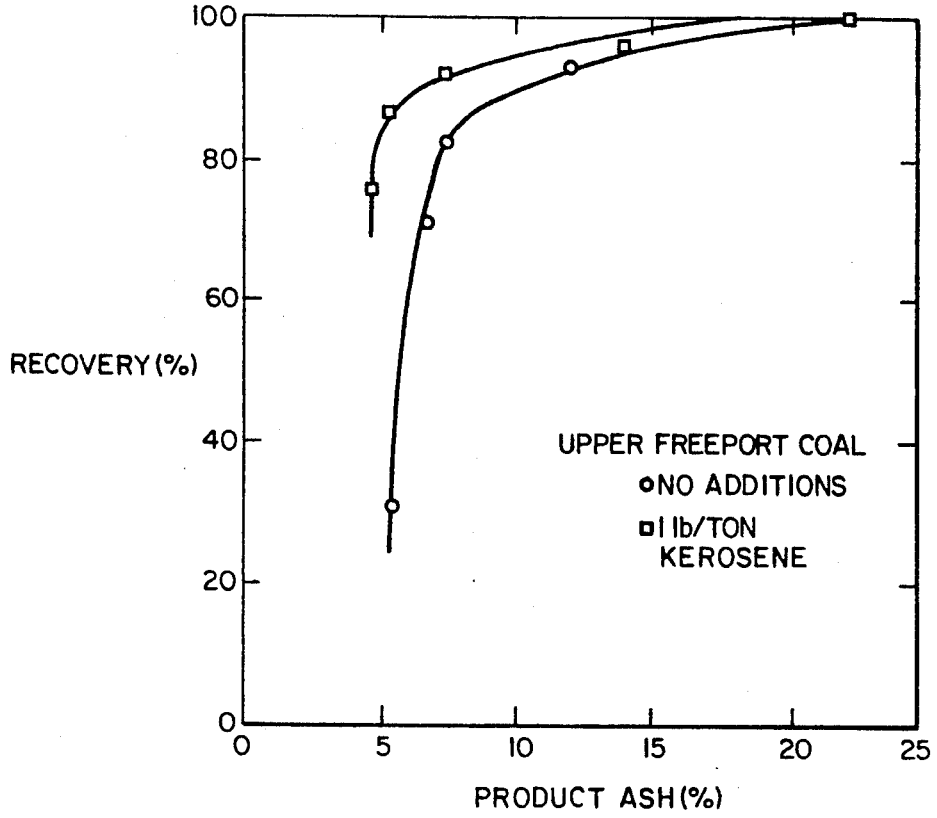
FIG. 5 is a graph showing the effect of adding 1 lb/ton of kerosene on coal recovery and product ash content in the process in accordance with the present invention for an Upper Freeport coal.

If a coal is partially oxidized, however, it is beneficial to add a small amount of hydrocarbon oil to enhance the hydrophobicity of the coal particles and, therefore, the hydrophobic interaction energy. FIG. 5 shows the results obtained for an Upper Freeport coal (22.2% ash) with and without using kerosene. With no kerosene, the ash content was reduced from 22.2% to 7.5%, with a combustible recovery of 82.9% after several stages of cleaning. Attempts to further reduce the ash content by increasing the number of cleaning stages resulted in a sharp decrease in combustible recovery. When using only 1-lb/ton of kerosene, which amounted to 0.0005% by weight of the coal, the result was improved significantly as shown. It is not likely that such a small dosage of hydrocarbon oil compared to what is normally used for oil agglomeration acted as a bridging agent. The kerosene may have simply increased the attractive hydrophobic interaction energy between coal particles and, hence, the coagulation efficiency.

Figure 6:
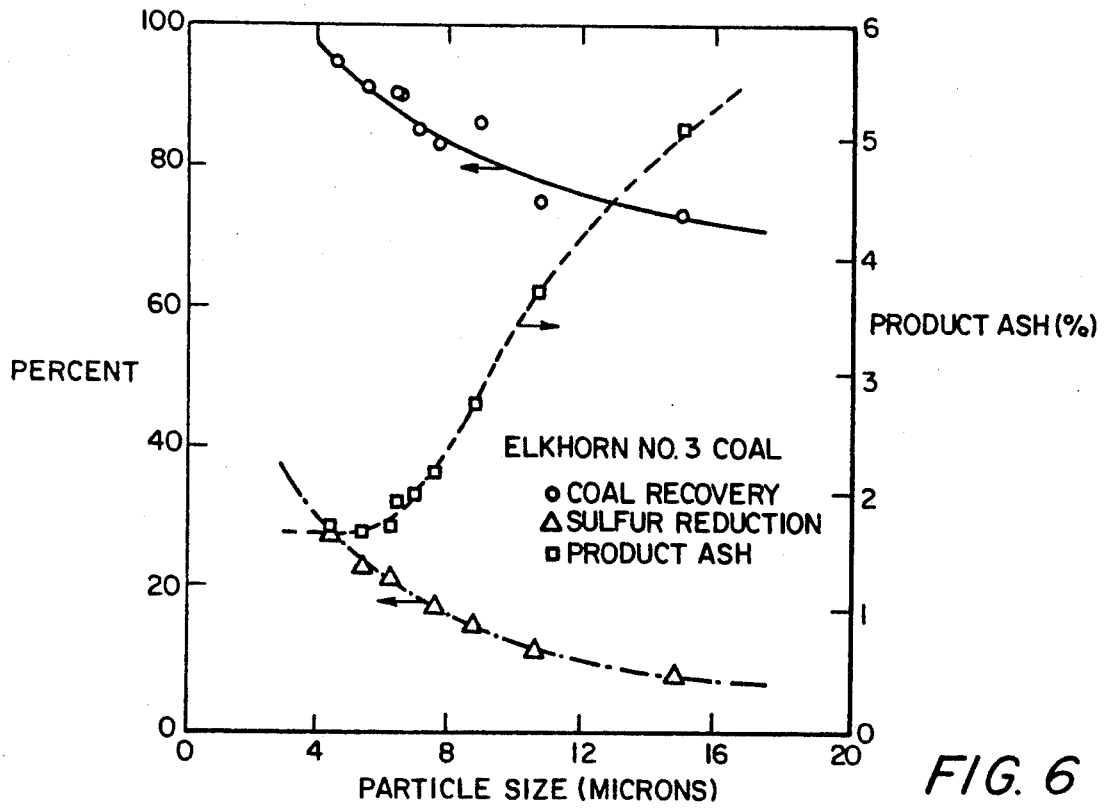
FIG. 6 is a graph showing the effect of particle size on the selective coagulation process in accordance with the present invention.
Figure 7A:
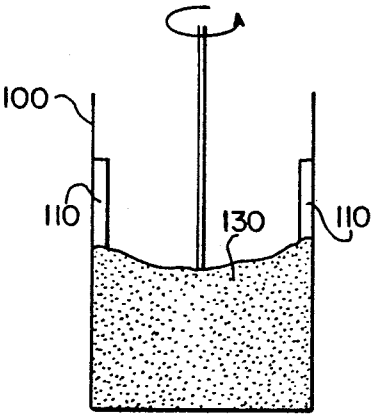
Figure 7B:
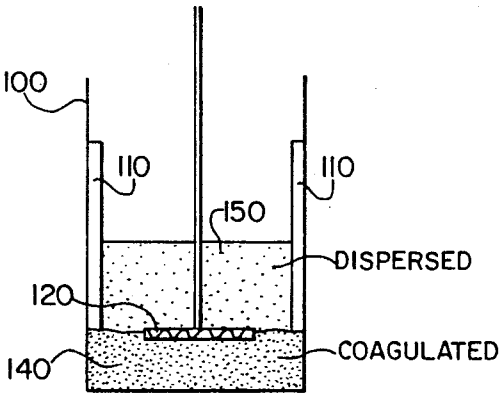
Figure 7C:
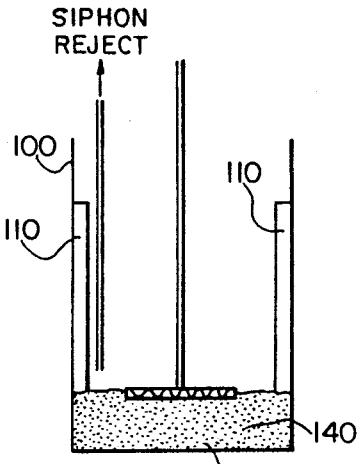

In order to study the effect of particle size, the Elkhorn No. 3 coal (feed ash 12%) was pulverized in an attrition mill for varying lengths of time and subjected to selective coagulation experiments. As shown in FIG. 6, both the ash and sulfur rejections were improved with decreasing particle size ($D_{50}$) below 20-micron, most probably due to increased liberation. The usual trade-offs between grade and recovery were not evident in this case, as the recovery was also improved. This may indicate that with decreasing particle size, the hydrophobic force prevailed over the inertia force.

Table I shows the results obtained with various coal samples in multiple stages of batch experiments. The coal samples were attrition-ground to 3- to 5-micron median size ($D_{50}$). Depending on the feed ash, washability characteristics, hydrophobicity and the number of cleaning stages employed, the product ash contents varied in the 0.36 to 7.5% ash range. The pyritic sulfur rejections varied from 57% to 88% for different coals. With the Elkhorn No. 3 coal, which assayed 12.0% ash and 0.25% pyritic sulfur in the feed, the product assayed only 0.03% pyritic sulfur. In general, the selective coagulation process gave very high recoveries. Most of the test results shown in Table I were obtained using tap water, while deionized water was used for some of the coal samples such as Pittsburgh No. 8, Illinois No. 6 and Upper Freeport coals. No hydrocarbon oils were used in any of the tests shown.

2. Continuous Tests

The first series of continuous selective coagulation tests were conducted using an elutriation column for separating coal coagula from dispersed minerals. Elutriators are commonly used for separating different sizes of particles based on the terminal settling velocities of the particles, which can be calculated using the Stokes equation. In the elutriation technique in accordance with the invention, the upward velocity of the water is adjusted so that it exceeds the settling velocity of the mineral matter but is lower than that of the coagula. The coal coagula then settle to the bottom of the column as the product. An advantage of using the elutriation column is that the problem of entrainment, which is common to all agglomeration processes, is minimized by virtue of the gentle stream of elutriation water rising from the bottom.

There are several reports which describe the elutriation technique for separating selectively flocculated material from the dispersed material. Read, "Selective Flocculation Separations Involving Hematit," *Transactions/Section C Mineral Processing and Extractive Metallurgy,* 80:C24–C31 (1971), reported an efficient upgrading of flocculated hematite by agitation in a rising stream of wash water using an elutriation column. Appleton et al, "Selective Flocculation of Cassiterite," *Journal of the South African Institute of Mining and Metallurgy,* pp. 117–119 (1975), achieved similar results by using an elutriation column for a system consisting of selectively flocculated cassiterite and a quartz particle suspension. Friend et al, "Cleaning a Selectively Flocculated Mineral Slurry," *Transactions Institute of Mining and Metallurgy,* 82:C235–C236 (1973); and "Some Physio-Chemical Aspects of the Separation of Finely-Divided Minerals by Selective Flocculation," *Chemical Engineering Science,* 28:1071–80 (1973), also used the technique when investigating the selective flocculation of a quartz/calcite mixture.

Referring now to FIG. 8, the method in accordance with the present invention using an elutriator 200 comprises pulverizing a coal sample in an attrition mill 205 to form a slurry, diluting the slurry in a sump 210, pumping it to a mixer 215, agitating it in the mixer 215, feeding the agitated slurry to the elutriation column 200, and separating the coagulated coal from the dispersed mineral matter using the elutriation column 200.

The slurry is fed into the elutriation column 200 at the bottom of the upper section **200*a*, where the diameter begins to narrow. The elutriation water is added into the column 200 through a Cole-Parmer Teflon variable-area flowmeter 220 using a circular disperser 225 resembling a sprinkler. It is added downwardly from the slurry feed point in the intermediate portion 200*b* of the column 200. The product is extracted from the lower section 200*c* of the column 200 using a Masterflex peristaltic pump 230. Tailings are allowed to flow naturally over the top of the upper section 200*a* into a launder 200*d*. Make-up water is added to the bottom of the intermediate section 200*b* using a sump 235 and a Masterflex peristaltic pump 240**.

In the first series of continuous selective coagulation tests, the processing steps included pulverizing a coal sample (Elkhorn No. 3) to 4.4-micron median size in an attrition mill 205 at 35% solids, diluting the slurry to 2% solids in sump 210, pumping it to mixer 215 for 20 minutes of agitation, and feeding it to the elutriator 200. No pH control was necessary in this case because the natural pH of 7.5 was well within the window of separation. The make-up water was added to the bottom section 200*c* of the column 200 at a rate equal to that of the clean coal product being removed, so that changes in the product removal rate had no effect on the flow rates in the separating zone of the column. The mixer 215 was constructed from a 6" diameter Plexiglas tubing with four ¼" Plexiglass baffles 215*a* placed vertically along the cell wall 215*b*. The impeller 215*c* was a 3" diameter Cowles blade, which was operated at 500 to 1800 rpm.

The results of the single-stage tests conducted on the Elkhorn No. 3 coals with different levels of feed ash are given in Table II. These results demonstrate that despite the relatively small sizes of the aggregates produced by the hydrophobic coagulation, the process can be operated continuously. It is believed that the elutriation technique employed here largely eliminated the entrainment problem associated with the batch tests, but did not necessarily eliminate the problem of entrapment. This problem can be eliminated if the clean coal product is repulped and agglomerated again in a multistage operation.

For these reasons, a single-stage continuous operation was equivalent to only about two stages of batch operation. One drawback of the elutriation technique was that due to the relatively small coagula size and, hence, the low settling velocity, long retention times were necessary. This means that the process would require a relatively large reactor, although it would be a simple device with no moving parts. For this reason, a rotating drum separator as shown in FIGS. 9 and 10 was developed.

The drum separator 300 comprises a horizontally disposed, rotatable cylindrical drum screen 305 for receiving the slurry, a feed conduit 310 for feeding the slurry into drum screen 305, a horizontally disposed static Plexiglass trough 315 disposed within drum screen 305, and a product conduit 320 connected to static trough 315 for transporting the agglomerated product out of drum screen 305. Drum screen 305 comprises a mesh material 305*b* wrapped around a cylindrical drum 305*d*.

A basin 325 is provided to receive drum screen 305 and for holding water and pulp. Drum screen 305 is rotatably supported in basin 325 by support means such as forward and rearward pairs of support columns 330 having rollers 335 rotatably mounted thereon. Basin 325 is provided with an outlet conduit 340 at the bottom thereof for transporting the tailings out of basin 325.

Rotation of drum screen 305 is accomplished by any conventional drive means, such as a motor 345 coupled to drum screen 305 by a horizontal drive shaft 350 collinear with the longitudinal axis of drum screen 305.

The agglomerated material is washed off of drum screen 305 and into static trough 315 by a water spray or water/air combination spray 350 positioned outside of drum screen 305 above static trough 315. The water spray 315 is composed of a ½" diameter hollow Plexiglass tube having 1/16" holes along the length of the tube 350.

Drum screen 305 is designed to separate agglomerated coal or graphite or similar material from dispersed mineral matter in accordance with the process of the invention. Feed slurry is inducted into the center of the slow rotating drum screen 305, which is partially submerged in a pool of water contained in a basin 325. The agglomerates grow in size while the pulp is gently agitated in inside the drum screen 305 by the rotating motion, while the mineral matter remain dispersed. The dispersed material flows through drum screen 305 and exits the pulp basin 325 through the outlet conduit 340, while the agglomerates are caught on the interior wall of the drum screen 305. The agglomerate size can be controlled by manipulating the retention time of the slurry inside the drum screen 305. The slurry retention time inside the drum screen 305 can be controlled by adjusting the water level in basin 325 and by controlling the feed rate through the feed pipe 310. As the drum screen 305 rotates, the agglomerated material is washed off of its interior wall and fall into static trough 3!5 by water spray or water/air combination spray 350. The agglomerated material is then carried out of static trough 315 by product conduit 320.

The drum separator developed for these experiments is made from a 325-mesh nylon cloth wrapped around an 8" diameter drum that is continuously rotated at a very slow speed (<1 rpm). The drum screen 305 is partially submerged into a pool of water. The slurry from the mixing tank is fed to the interior of the drum screen 305 through static feed pipe 310. The dispersed minerals pass through the screen 305*b*, while the coagula remain on it. As the screen 305*b* rotates, the coagula are washed off the screen 305*b* into stationary trough 315 located inside the drum 305*a*, and then discharged out of the drum 305*a* through product conduit 320. During this process, a portion of the water flowed along the surface of the screen 305*b*, providing a mechanism for removing entrained ash-forming minerals. This technique requires only 3 to 4 minutes of retention time, which is an order of magnitude shorter than the method of using the elutriator.

The initial tests using the drum separator were conducted on a sample of amorphous graphite assaying 17.00% ash and 81.03% fixed carbon (FC). The sample was attrition-ground for 2 hours, diluted to 2% solids, adjusted to pH 11, and fed to the separator at a feed rate of 330 ml/min, so that the retention time was about 6.5 minutes. To minimize the entrapment problem, the concentrate was repulped and cleaned twice. The final product assayed 5.36% ash and 91.8% FC with 99.9% recovery, as shown in Table III. The high ash contents of the tailings also reflect the high efficiency of separation.

As another example of using the drum separator, a low-grade crystalline graphite containing 85.26% ash and 11.91% FC was processed. The operating conditions were similar to the amorphous graphite except that the sample was attrition-ground for only 20 minutes and the pH adjusted to 10. The results of the three stages of selective coagulation tests are shown in Table IV. The final product contained 7.7% ash and 86.9% FC with 92.4% carbon recovery. The efficiency of separating the coagula either by using the drum screen (FIGS. 9 and 10) or the elutriator (FIG. 8) in accordance with the present invention will be increased if the size or weight of the coagula is increased. As a means of achieving this, several different methods have been identified in accordance with the present invention. These are:

1) Adding a sufficient amount of large particles of coal to the fine coal processing stream, so that they can coagulate with the fine particles and produce larger and heavier coagula;
2) Adding hydrophobized magnetic particles of high specific gravity (SG) to the process stream, so that the settling rates of the coagula can be increased substantially; and 3) Adding hydrocarbon oil to the slurry in an amount which is still well below what is normally used in oil agglomeration, so that the coagula size can be increased.

The magnetic particles can be hydrophobized by coating the surface with appropriate surfactants or any other hydrophobic material. They can be removed from the processed coal by magnetic separation for reuse. The coarse coal can also be recovered for reuse by screening.

Oil agglomeration is a highly efficient process for cleaning fine coals, except that the oil consumption is prohibitively high. Use of recoverable agglomerants, such as pentane and liquid $CO_2$, can reduce the consumption drastically, but the recovery process is costly. The process in accordance with the present invention requires no agglomerant, making it economical. Furthermore, for very hydrophobic coals and graphites, the process in accordance with the present invention does not require high-shear agitation, other than what is normally needed to disperse the slurry and increase the particle-particle collision rate. The process may need pH regulators to maximize the separation efficiency; in many cases, however, the natural pH provides a sufficient window of separation. For the case of the process water containing large amounts of dissolved ions, it may be useful to add reagents, such as EDTA, dicarboxylic acids, short-chain fatty acids, etc., to control the water quality. Using some dispersant may also enhance the separation efficiency, which is the case with any physical coal cleaning process. For processing oxidized coals, a small amount of reagent to restore the hydrophobicity may be useful. The process of separating the coagula from the dispersed phase can be facilitated by using reusable hydrophobic "seed" particles such as coarse coal, magnetite, iron filings, etc. The separation of coagula can also be enhanced by increasing the coagula size by using oil well below the amount that is normally used in conventional oil agglomeration process. Further, the process in accordance with the present invention may be extended to materials which are naturally non-hydrophobic by coating particles of the material with surfactants or any other reagents that can render them hydrophobic; or to manufactured hydrophobic materials such as "TEFLON"; or to naturally hydrophobic materials as found in nature, such as elemental sulfur and molybdenite.

The selective coagulation process in accordance with the present invention is extremely simple. A pulverizer, if necessary, a mixer, and a separator are the only equipment needed. The separation of coagula from dispersed particles can be accomplished in a variety of ways, including but not limited to sedimentation, elutriation, screening, centrifuging and froth flotation. One advantage of coagulating particles by hydrophobic coagulation, as compared to flocculating them using polymeric water-soluble organic flocculants, is that the resulting aggregate is hydrophobic, which will allow the coagula to be separated from the dispersed hydrophilic particles by froth flotation. The process may also have an advantage in the rejection of coal pyrite, since no hydrocarbon oils are used for agglomeration.

Thus, it can be seen that the process in accordance with the present invention can be applied to separating various kinds of hydrophobic particles from the associated hydrophilic particles, and that the process can be operated under various conditions depending on the material characteristics by adjusting the physical parameters, including but not limited to the pH, the particle size, and the percent solids, and by changing the slurry medium, the specific energy input, and the number of treatment stages While preferred embodiments of the process in accordance with the invention and apparatus therefore have been disclosed, it should be understood that the spirit and scope of the invention is to be limited solely by the appended claims, since numerous modifications of the disclosed embodiments will undoubtedly occur to those of skill in the art.

What is claimed is:

1. A method for separating fine particles of a hydrophobic material from a mixture of fine particles including at least one component comprising a non-hydrophobic material by selective hydrophobic coagulation, wherein said particles have a mean particle size of less than approximately 25 microns, comprising the steps of:

a) adding water and up to 1% by weight of hydrocarbon oil to the mixture of fine particles to form a suspension of the mixture of fine particles in the water;

b) allowing the particles of the hydrophobic material to coagulate through the action of attractive hydrophobic interaction forces acting thereon as the major driving force for forming coagula containing said hydrophobic material, while leaving the particles of the non-hydrophobic materials in a dispersed state; and c) separating the coagula from the dispersed particles of the non-hydrophobic material.

2. The method of claim 1, wherein in step b), the suspension is agitated just sufficiently to disperse the particles of non-hydrophobic material, to promote particle-particle collision of hydrophobic material, and to provide a sufficient kinetic energy to the colliding particles of hydrophobic material to overcome the energy barrier against coagulation.

3. The method of claim 1, wherein the hydrophobic material is weakly hydrophobic, and wherein the method comprises the additional step of enhancing the hydrophobicity of the hydrophobic material prior to said step a).

4. The method of claim 1, wherein said enhancing step comprises adding a reagent.

5. The method of claim 1, wherein step c) comprises sedimentation of the coagula in a container and formation of a supernatant containing the particles of the non-hydrophobic material, and siphoning off the supernatant.

6. The method of claim 1, wherein step c) comprises elutriation of the coagula.

7. The method of claim 1, wherein step c) comprises screening of the coagula.

8. The method of claim 1, wherein step c) comprises floatation of the coagula.

9. The method of claim 1, wherein step c) comprises material is a material which is naturally hydrophobic as found in nature or as manufactured.

10. The method of claim 9, wherein the hydrophobic material is a material selected from the group consisting of coal, graphite, elemental sulfur, molybdenite, diamond, talc or poly(tetrafluoroethylene).

11. The method of claim 1, wherein the method further comprises the step of coating fine particles of a naturally non-hydrophobic material with a hydrophobic substance to render the surface hydrophobic to form fine particles of a hydrophobic material, prior to or during step a).

12. The method of claim 11, wherein the hydrophobic substance is a surfactant.

13. The method of claim 1, further comprising the steps of:

d) following step c), adding water to the coagula to form a mixture, and agitating the mixture to liberate particles of the non-hydrophobic material entrained and entrapped in the coagula, and to form a new suspension of the particles of hydrophobic and non-hydrophobic materials in the water; and e) repeating steps b) and c).

14. The method of claim 13, further comprising the step of:

f) repeating steps d) and e) until substantially all of the particles of the non-hydrophobic material have been removed from the coagula of the hydrophobic material.

15. The method of claim 13, wherein the hydrophobic material is coal, and in steps a) and d), the pH of the suspension is between 6.5 and 9.5.

16. The method of claim 1, further comprising the additional step of adjusting the pH of the suspension to prevent the particles of the non-hydrophobic material from electrolytically coagulating, between steps a) and b).

17. The method of claim 1, wherein the hydrophobic material is coal, and wherein the pH of the suspension is between 6.5 and 9.5.

18. The method of claim 1, wherein the hydrophobic material is coal and the solids concentration is between approximately 0.5% and 3.0%.

19. The method of claim 1, wherein in step a), a sufficient amount of large hydrophobic particles is added so as to be coagulated with the fine particles of the hydrophobic material in step b), whereby the coagula formed in step b) are larger and heavier than coagula formed without adding the large hydrophobic particles, and further comprising the step of:

d) recovering the large hydrophobic particles after step c).

20. The method of claim 19, wherein step d) comprises screening of the coagula.

21. The method of claim 1, wherein in step a), hydrophobized magnetic particles are added to be coagulated with the fine particles of the hydrophobic material in step b), whereby the coagula formed in step b) are larger or heavier than coagula found without adding the magnetic particles, and further comprising the step of:

d) recovering the hydrophobized magnetic particles after step c).

22. The method of claim 21, wherein step d) comprises magnetic separation.

23. The method of claim 1, wherein steps a) and b) are carried out without enhancing the hydrophobicity of the hydrophobic material.

24. The method of claim 1, further comprising the steps of:

providing a horizontally disposed, rotatable cylindrical drum screen means for receiving the suspension and for retaining coagula of the hydrophobic material while allowing the non-hydrophobic material to pass through in the form of a dispersed slurry;

providing horizontally disposed static trough means disposed within the drum screen means for receiving the coagula of the hydrophobic material; and partially submerging the drum screen means in a pool of water;

wherein said step b) comprises feeding the suspension into the drum screen means while rotating the drum screen means; and wherein said step c) comprises the substeps of:

i) washing the coagula of the hydrophobic material off of the drum screen means and into the trough means; and ii) transporting the coagula of the hydrophobic material out of the drum screen means.

25. A method for separating a hydrophobic constituent of a composite material comprising at least one non-hydrophobic constituent from the non-hydrophobic constituent by selective hydrophobic coagulation, comprising the steps of:

a) pulverizing the composite material in water to form fine particles of the hydrophobic and non-hydrophobic constituents to liberate the hydrophobic constituent from the non-hydrophobic constituent and to form an aqueous slurry, wherein said fine particles have a mean particle size of less than approximately 25 microns;

b) diluting the slurry to a desired pulp density and adding up to 1% by weight of hydrocarbon oil;

c) agitating the slurry to selectively coagulate the fine particles of the hydrophobic constituent to form coagula containing said hydrophobic constituent through the action of attractive hydrophobic interaction forces acting thereon as the major driving force, while leaving the fine particles of the non-hydrophobic constituent in a dispersed state; and d) separating the coagula from the dispersed fine particles of the non-hydrophobic constituent.

26. The method of claim 25, wherein step d) comprises settling the coagula in a container and forming a supernatant containing the particles of the non-hydrophobic constituent, and siphoning off the supernatant.

27. The method of claim 25, wherein step d) comprises feeding the agitated slurry to an elutriation column.

28. The method of claim 25, wherein step d) comprises feeding the agitated slurry to a drum separator.

29. The method of claim 28, wherein step d) comprises:

i) providing a pool of water, a slow-turning cylindrical screen which is partially submerged in the pool of water, and a static trough positioned inside the screen;

ii) inducting the agitated slurry to the interior of the cylindrical screen;

iii) allowing the coagula of the hydrophobic constituent to grow in size during the time that they are in the pool of water inside the screen, while the fine particles of the non-hydrophobic constituent remain dispersed;

iv) allowing the dispersed non-hydrophobic particles to flow through the screen while the coagula of the hydrophobic constituent are caught on the interior wall of the screen;

v) as the screen rotates, washing the coagula off of the interior wall of the screen and into the static trough; and vi) carrying the coagula out of the static trough.

30. The method of claim 25, wherein step d) comprises flotation of the coagula.

31. A method for separating fine particles of oxidized coal from a mixture of fine particles including at least one component comprising a non-hydrophobic material by selective hydrophobic coagulation, wherein said particles have a mean particle size of less than approximately 25 microns, comprising the steps of:

a) adding to the mixture of fine particles reagent means for enhancing the hydrophobicity of the coal, said reagent means comprising hydrocarbon oil in an amount which is less than 1% by weight of the clean hydrophobic material produced;

b) adding water to the mixture of fine particles to form a suspension of the mixture of fine particles in the water having a solids concentration of between approximately 0.5% and approximately 3.0% by volume;

c) allowing the particles of the coal to coagulate through the action of attractive hydrophobic interaction forces acting thereon as the major driving force for forming coagula containing said hydrophobic material, while leaving the particles of the non-hydrophobic materials in a dispersed state; and d) separating the coagula from the dispersed particles of the non-hydrophobic material.

32. The method of claim 31, wherein the step c), the suspension is agitated to disperse the particles of non-hydrophobic material, to promote particle-particle collision of hydrophobic material, and to provide a sufficient kinetic energy to the colliding particles of hydrophobic material to overcome the energy barrier against coagulation.

33. The method of claim 31, wherein step d) comprises elutriation of the coagula.

34. The method of claim 31, wherein step d) comprises screening of the coagula.

35. The method of claim 31, wherein step d) comprises floatation of the coagula.

36. The method of claim 31, further comprising the steps of:

e) following step d), adding water to the coagula to form a mixture, and agitating the mixture to liberate particles of the non-hydrophobic material entrained and entrapped in the coagula, and to form a new suspension of the particles of coal and non-hydrophobic material in the water; and f) repeating steps c) and d).

37. The method of claim 36, further comprising the step of:

g) repeating steps e) and f) until substantially all of the particles of the non-hydrophobic material have been removed from the coagula of the coal.

* * * * *